US007594640B1

(12) United States Patent
Mann

(10) Patent No.: US 7,594,640 B1
(45) Date of Patent: Sep. 29, 2009

(54) MULTI-LINE, MULTI-FUNCTION YACHT WINCH

(76) Inventor: Samuel J. Mann, c/o Schweitzer Comman Gross & Bondell LLP, 292 Madison Ave. - 19th Floor, New York, NY (US) 10017

( * ) Notice: Subject to any disclaimer, the term of this patent is extended or adjusted under 35 U.S.C. 154(b) by 0 days.

(21) Appl. No.: 12/105,785

(22) Filed: Apr. 18, 2008

(51) Int. Cl.
*B66D 1/14* (2006.01)

(52) U.S. Cl. ..... 254/294; 254/278; 254/295; 254/316

(58) Field of Classification Search ..... 254/278, 254/287, 294, 295, 298, 299, 316, 317
See application file for complete search history.

*Primary Examiner*—Emmanuel M Marcelo
(74) *Attorney, Agent, or Firm*—St. Onge Steward Johnston & Reens LLC

(57) ABSTRACT

A multi-function winch for handling multiple lines of the running rigging of a sailing yacht. The winch incorporates multiple winch drums capable of releasing, retrieving and storing working lines of the yacht. The multiple winch drums are mounted in an axially stacked relation on a single drive shaft. Individual ones of the drums can be engaged to be driven by the main shaft of the winch, while the others remain stationary or, where appropriate, free wheel and controllably release lines stored thereon. A rotatable selector lever, located at the top of the winch, is manipulated to engage a selected drum for driven operation. Level wind features can also be provided to assure neat and compact winding of retrieved lines.

10 Claims, 11 Drawing Sheets

MULTI-LINE, MULTI-FUNCTION YACHT WINCH

RELATED APPLICATION

This application is related to the copending U.S. application of Samuel J. Mann, Ser. No. 11/759,398, filed Jun. 7, 2007, and the content of said application is incorporated herein by reference.

BACKGROUND OF THE INVENTION

Sailing yachts of greater than minimal size typically utilize one or more winches to assist in handling of the running rigging, primary elements of which include sheets, halyards, and furling lines. When sailing yachts reach a certain size, for example, 35 feet in length, the forces involved in handling sheets and halyards in particular can become very large, and power-operated winches are quite commonly employed in these larger yachts. Whether utilizing manually operated or power operated winches, however, the handling of running rigging with conventional equipment is somewhat complicated and can be very dangerous.

In the before mentioned copending application, a novel and improved form of yacht winch is disclosed, in which a winch drum serves not only to provide the necessary force to retrieve or trim a line under significant load, but also serves to wind up and store the line on the winch drum. Numerous advantages result from this arrangement, among which is the avoidance of manual handling of lines under load during either easing (letting out) or trimming (retrieving), such that crewmembers are not exposed to the hazards of manual handling of lines under load, as on conventional winches. Even where conventional winches are provided with self-tailing features, manual handling is nevertheless required to set up the line on the winch in the first instance, while easing of the line requires it to be manually removed from the self-tailing mechanisms, sometimes partly unwound from the winch drum and manually eased against the friction of the winch drum. If these operations are not properly performed, injury can result. Such risks are avoided where the line is both retrieved and released by controlled operations of the winch drum.

Another significant advantage of the winch of the above mentioned Mann application is that all of the line is wound up and stored on the winch drum. With conventional winch equipment, all of the line on the "downstream" side of the winch lies loose on the deck or in the cockpit. If not coiled and neatly placed after each adjustment of the line, the loose end becomes unsightly and can easily become entangled, creating potentially dangerous situations.

The winch disclosed in the above mentioned prior application also is uniquely designed to be operated alternatively by power or manual means. Where power operation is provided, the winch normally will be operated in a power-only mode. However, an advantageous arrangement is provided to accommodate manual operation as a backup, in the event of malfunction of the power system. Alternatively, the advantageous functional features of that winch can be realized in a less costly, manually operated version.

SUMMARY OF THE INVENTION

The present invention is directed to a winch for sailing yachts which, while incorporating many of the novel and advantageous features of the winch described in the copending Mann application, has novel arrangements to accommodate the handling of multiple lines on the same winch by providing multiple winch drums in a compact, axially stacked configuration, with a uniquely simplified arrangement for selectively actuating individual winch drums for the handling of selected lines of the yacht's running rigging. By way of example and not of limitation, a yacht winch according to the present invention may be provided with three winding drums, one for the yacht's main sail halyard, a second for handling an in-boom roller furling of the main sail, and a third for controlling the main sheet. As will be understood, modern large sailing yachts may have a considerable variety of running rigging lines, such as running backstays, jib halyards, jib furling lines, spinnaker halyards, reefing lines, and the like that can be advantageously and safely handled using a multi-line, multi-function winch according to the present invention.

In accordance with the invention, a yacht winch is provided with a single primary drive shaft, which mounts a plurality of axially adjacent line retrieving drums. The primary shaft, which can be driven by power or manual means, or selectively by either, is provided with a unique driving arrangement for selective engagement with individual ones of the multiple line retrieving drums. Accordingly, multiple lines of a yacht's running rigging may be controllably retrieved and stored by selective driving engagement of the individual drums. In a typical installation, at least some of the lines, and more typically all, are associated with releasable line clutches, which can be of any of number of well known types. The line clutches allow movement of the line in the retrieving direction, while securing the line against movement in the releasing direction. Accordingly, when a winch drum is disengaged from the primary shaft, the line remains secured by the clutch in its adjusted position. The line can be released at any time by opening of the clutch mechanism. The disengaged winch drum can free wheel, to allow free release of its line. While the specific form of the invention herein disclosed is expected to be utilized in connection with independently mounted and operated line clutches, it is contemplated that suitable friction or mechanical means may be incorporated into the winch structure itself to serve the same function as the independent line clutches.

In a particularly advantageous form of the invention, the primary drive shaft is provided with a plurality of axially extending drive keys, one for each of the winding drums mounted on the shaft. These keys are received in axially extending key slots in the primary shaft, and a selector mechanism is provided for engaging individual drive keys with their respective winding drums. The individual drums are formed with one or more key-engaging slots. Accordingly, when a selected key is displaced outwardly from a normally retracted position within the primary shaft, the displaced key engages a particular one of the multiple winding drums, to connect that drum for rotation with the primary shaft. Where powered operation of the winch is provided for, the start-up controls for the drive motor include means to provide for a slow speed start up. This allows for an initial slow speed operation of the primary shaft, for the first few degrees of rotation, while the outwardly displaced key seeks alignment with a key-engaging slot in the selected winch drum.

In a preferred form of the invention, selection of a particular winding drum to be activated is controlled by a manually operated selector element mounted at the top of the winch. The selector element is rotatable to any of several predetermined positions, to apply outward displacement pressure to a pre-selected drive key, or to a "neutral" position causing all drive keys to remain retracted. In more comprehensive versions of the winch, these functions, as well as operations of the line clutches, may be controlled remotely through the use of solenoids, stepper motors and the like.

In some preferred configurations of the new winch, it is not uncommon for a pair of winch drums to be operated in combination, where one of the drums is retrieving line, while the other is allowing line to be released. For example, one drum may be operated to retrieve the yacht's main halyard and thus hoist the main sail, while a second drum is releasing line associated with an in-boom furling mechanism. For lowering of the sail, the winch for the in-boom furling mechanism would be operated for line retrieval, while the winding drum for the main halyard would be releasing line to allow a controlled lowering of the sail. Inasmuch as the drum for a line being released will be in a free wheeling mode, the drums advantageously are provided with controllable line release speed controls to apply moderate resistance to the line being released, enabling it to be removed from the drum in an orderly fashion while the companion line is being retrieved. Additionally, it is contemplated that automatic control means may be incorporated with the line clutches or alternative mechanisms such that a line can be automatically released for pay out when required, as for example where halyard and furling lines are worked in tandem.

To particular advantage, the winch mechanism of the present invention can share the advantageous drive mechanisms of the prior copending Mann application to accommodate power-driven operation or, alternatively, multi-speed manual operation, in conjunction with level wind arrangements for applying the retrieved lines uniformly on their respective winding drums, where desired. The ability to share a common driving mechanism enables significant reduction in overall manufacturing costs as well as standardization of installation procedures, as will be understood.

The winch of the invention further includes an advantageous form of level wind arrangement, which enables a single level wind mechanism to function with respect to multiple winch drums, to apply level wind to whichever drum has been selected for line retrieval.

For a more complete understanding of the above and other features and advantages of the invention, reference should be made to the following detailed description of a preferred embodiment, and to the accompanying drawings.

DESCRIPTION OF A PREFERRED EMBODIMENT

Figure 3:
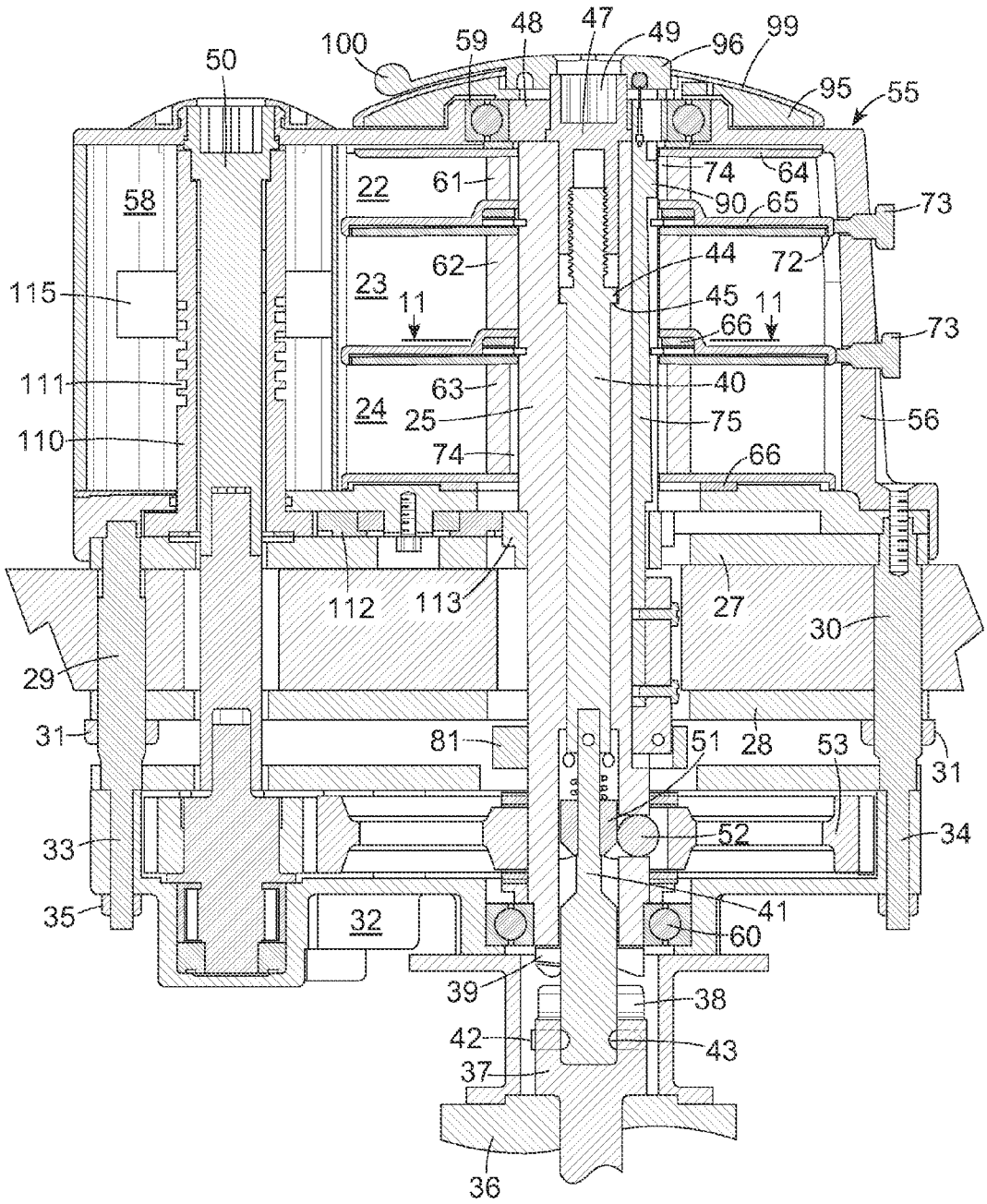
FIG. 3 is a cross sectional view of the winch of FIG. 1.

Referring now to the drawings, the reference numeral 20 designates a deck or cabin top of a sailing yacht (not shown) on which the winch of the invention, designated by the numeral 21, is mounted. According to the invention, the winch 21 comprises three winch drums 22, 23, 24 arranged in vertically stacked relation and mounted on a main vertical drive shaft 25 (FIG. 3). The three winch drums 22-24 are independently rotatable on the main drive shaft 25 and, as will be further described, are selectively individually driven by the drive shaft 25. In the illustrated form of the invention, the upper winch drum 22 is relatively narrower and intended for use with relatively shorter line, such as a main sheet (used for controlling the angle of the main sail with respect to the wind). The second and third drums 23, 24 are wider and of larger capacity, dimensioned to receive longer lines, such as a main halyard (used for raising and lowering the main sail), and an in-boom furling line.

Figure 1:
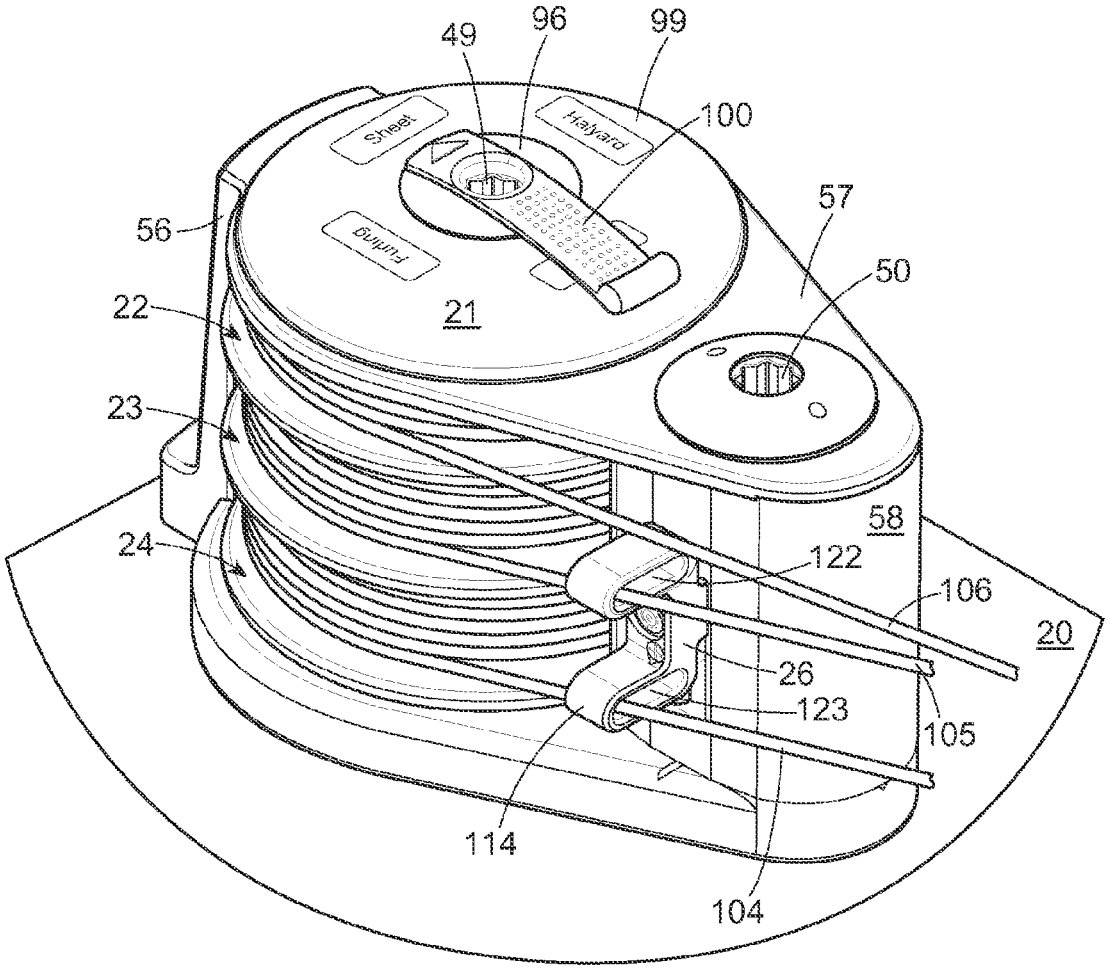
FIG. 1 is a top, front perspective view of a preferred embodiment of the multi-line, multi-function winch of the invention.
Figure 2:
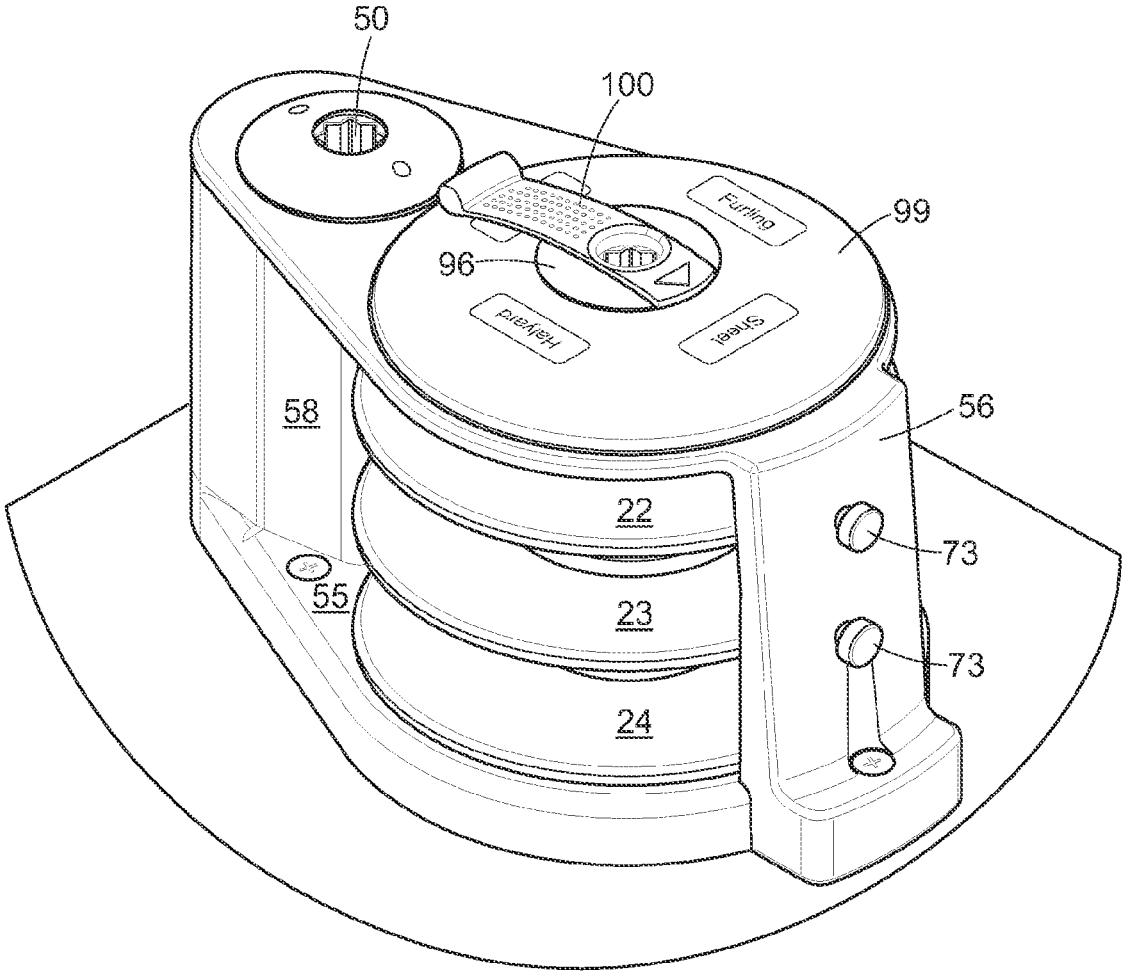
FIG. 2 is a top, rear perspective view of the winch.

As indicated in FIG. 1, a dual line guide element 26 is mounted in front of the lower drums 23, 24 and is arranged for limited vertical reciprocating motion associated with rotation of the main drive shaft 25 such that, when line is being retrieved on either of the larger winch drums 23, 24, such lines are laid onto the drums with even back and forth movements, to maximize the line holding capacity of the drums.

With reference to FIG. 3, the winch 21 is mounted on deck 20 by means of a base plate 27 at the upper surface of the deck and a clamping plate 28 underneath. The base and backing plates 27, 28 are tightly clamped to the deck 20 by a plurality of positioning bolts, two of which (bolts 29, 30) are illustrated in FIG. 3. The upper ends of the bolts 29, 30 threadedly engage the base plate 28, while nuts 31 hold the base plate 28 tightly against the bottom surface of the deck 20.

As described in more detail in the copending application Ser. No. 11/759,398, a gear box 32, which includes the multi-speed drive mechanisms for manual operation of the winch, is fixed to the plates 27, 28 by means of downwardly projecting portions 33, 34 of the positioning bolts. Nuts 35 engage the lower extremities of these projecting portions and mount the gear box tightly on the positioning bolts. The positioning bolts locate the gear box 32 accurately in precise parallelism with the winch base, regardless of possible variations in the thickness of the deck 20 and variations in the contours of its undersurface.

The winch mechanism of the present invention preferably incorporates a power drive, comprising a motor (not shown) driven electrically or hydraulically, connected through a gear box 36 to an output shaft 37. The drive shaft 37 forms part of a drive clutch mechanism engageable with the main drive shaft 25 as will be described. The shaft 37 is provided with upwardly projecting teeth 38 arranged, when the shaft is elevated from the position shown, to engage downwardly projecting teeth 39 on the bottom of the main drive shaft 25.

For normal operations of the winch, the motorized output shaft 37 will be engaged with the drive shaft 25. This is effected by a control stem 40, which extends axially through the center of the shaft 25 and is connected with an extension 41 at the lower end of the stem 40. The extension projects below the end of the drive shaft 25 and engages the motor-driven output shaft 37. By means of a pin 42 engaged in an annular groove 43 in the extension 41, the extension and the motorized output shaft 37 are locked together for vertical movement, while accommodating relative rotation between them.

The upper end of the control stem has a flange 44 which rests on an internal shoulder 45 in the drive shaft 25. The upper end 46 of the control stem is threaded and engages internal threads of a socket member 47. The socket member 47 is seated on the upper end of the drive shaft 25, and is confined thereon by a ring 48 which is fixed to the shaft. The socket member 47 has an upwardly opening socket 49 therein for the reception of a standard winch handle (not shown) by which the socket member can be rotated.

In the illustrated configuration of FIG. 3, the winch is set up for manual operation. Such operation is effected by clockwise rotation of the socket member 47, using a winch handle, or by rotation of a second socket member 50. As explained in greater detail in the before mentioned copending Mann application, manual operation of the winch through the socket members 47 or 50 operates through the mechanisms of the gear box 32 to provide for manual operation in any of three-speeds. For powered operation of the winch, which is expected to be its normal mode of operation, the socket member 47 is rotated in a counterclockwise direction by means of a winch handle. The control stem 40, which is slideably but non-rotatably received within the shaft 25, is drawn upwardly by the threaded connection between the upper end 46 of the control stem and the socket member 47. When the control stem reaches its maximum upper position, in which the flange 47 abuts the lower end of the socket member 47, the clutch teeth 38, 39 of the motorized output shaft 37 and drive shaft 25 are mutually engaged. Rotation of the main drive shaft 25 is thus under the control of the motor-driven output shaft 37.

As explained in the before mentioned copending application, when the control stem 40 and the attached extension 41 are elevated, a conical cam element 51 is elevated, clutch balls 52, connecting the drive shaft 25 and a main drive gear 53, are allowed to retract inwardly, disconnecting the drive shaft 25 from the gear 53. Thus, motor-powered operation of the shaft 25 is independent of the gear mechanisms contained within the gear box 32.

Above the deck 20, the winch mechanism comprises a base member 54, which is secured to the deck-mounted base plate 27. A frame member 55 is secured to the base member 54, and has a portion 56 extending upward along the back sides of the winch drums 22, 24 and a portion 57 extending over the tops of the drums and also over a level wind mechanism generally designated by the numeral 58. A ball bearing 59 is seated in the upper portion 57 of the winch frame and surrounds the ring 48 to rotatably support the upper end of the main shaft 25. A second ball bearing 60 is located at the bottom of the shaft 25 to support the lower end thereof.

Figure 4:
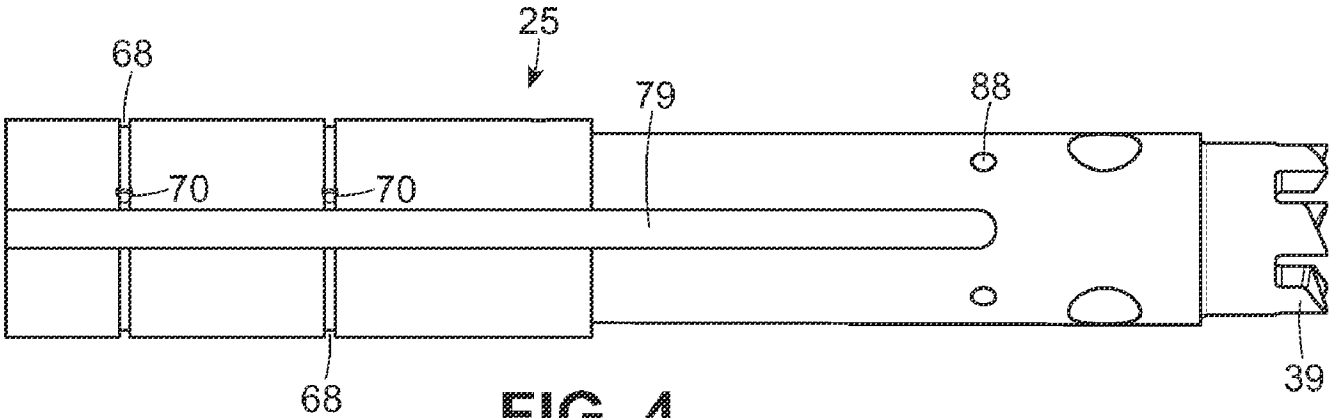
FIG. 4 is an elevational view of the primary drive shaft incorporated in the new winch.
Figure 5:
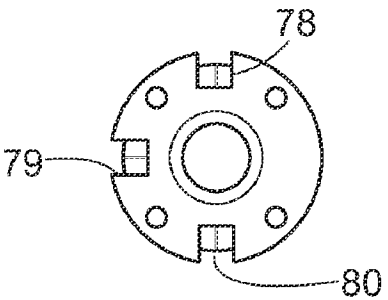
FIG. 5 is a top view of the drive shaft of FIG. 4.
Figure 11:
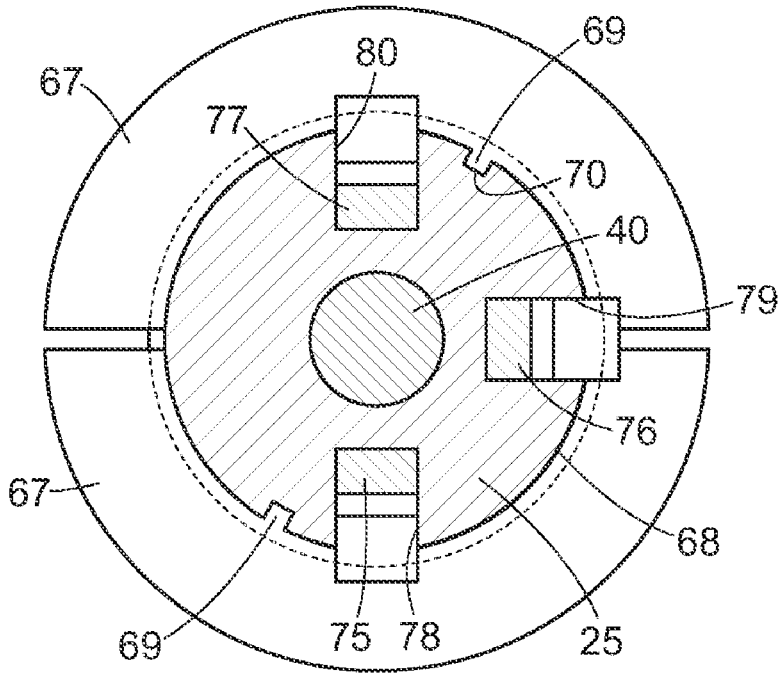
FIG. 11 is a cross sectional view taken generally on line 11-11 of FIG. 3.

Each of the winch drums comprises a central core sleeve 61-63, which closely surrounds the main shaft 25 and is arranged to rotate with respect to the shaft. Each of the core sleeves is assembled with a top flange plate 64 and a bottom flange plate 65 secured respectively to upper and lower ends of the core sleeves and defining therewith the individual winch drums. The lower flange plate 65 of each drum is supported by a roller bearing 66. The roller bearing for the lowermost drum 24 is supported by the winch base 54, while the roller bearings for the two upper drums 22, 23 are supported by means of pairs of half-ring elements 67 (FIG. 11) which are engaged in annular grooves 68 in the main shaft 25 (FIG. 4). The half-ring elements are provided with inwardly projecting tabs 69 which engage recesses 70 at the bottoms of the grooves 68 to prevent rotation of the half-ring elements with respect to the main shaft 25.

To advantage, the lower flange plates 65 of the upper winch drums 22, 23 are formed with upwardly offset portions 71 at their inner edges to receive and confine the half-ring elements 67 and the bearings 66. The lower drum flange plates 65 also are formed with downwardly projecting edge flanges 72 which minimize the entry of spray and dirt into the bearing areas underneath the flange plates.

As will be further described, the three winch drums 22-24 are arranged for independent rotation with respect to each other and with respect to the main shaft 25. During winch operations, a selected one of the winch drums will be engaged with the main shaft 25, while the other drums normally remain stationary while being able to free wheel if desired to enable line to be released. To provide a desired level of resistance or back pressure to lines being drawn off of disengaged drums, adjustable line release control elements 73 are arranged to engage edge flanges 72 of at least selected drums to resist free rotation thereof.

Figure 6:
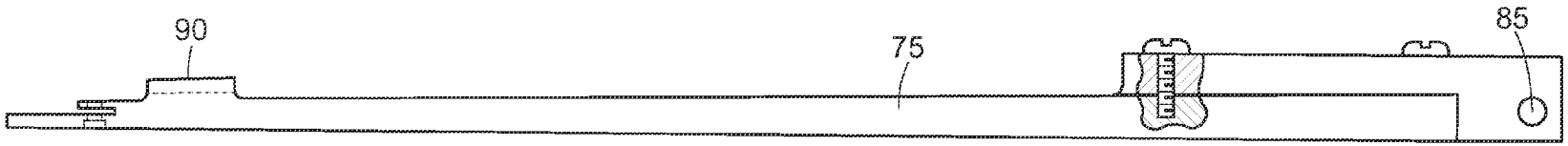
FIGS. 6, 7 and 8 are elevational views of drum engagement keys incorporated in the winch mechanism of the invention, enabling individual drums of a multi-drum winch to be engaged with the winch-driving mechanism.
Figure 7:
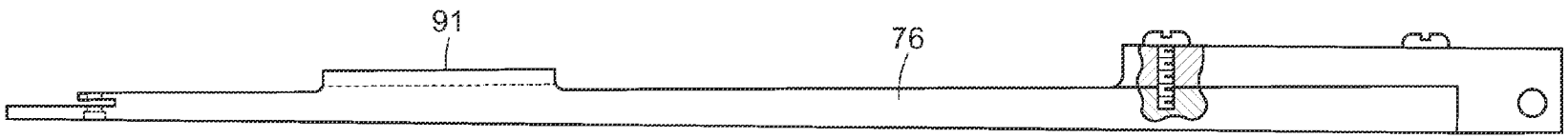
Figure 8:
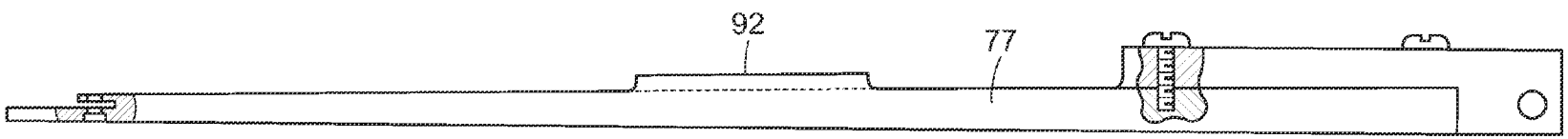
Figure 10A:
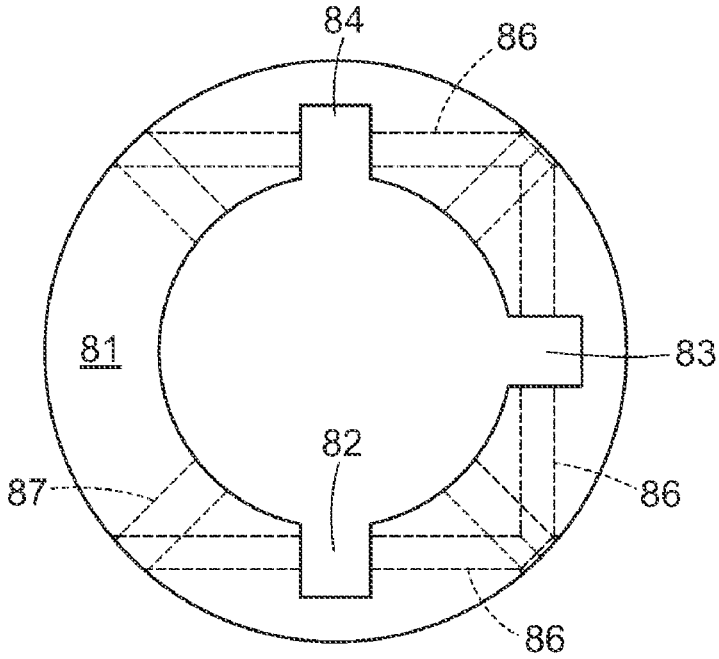
FIG. 10A is a top plan view of a mounting collar for pivotally mounting the drum engagement keys of FIGS. 6-8 to the primary drive shaft of FIG. 4.
Figure 10B:
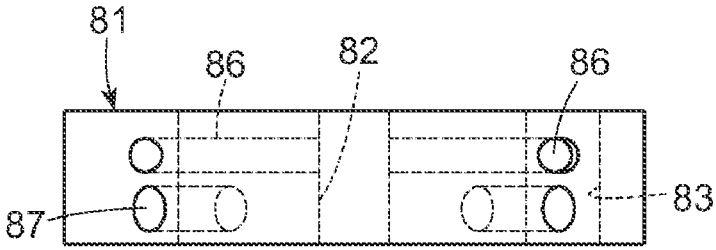
FIG. 10B is a side elevational view of the mounting collar of FIG. 10A.

In accordance with one aspect of the invention, novel mechanisms are provided for effecting selective drive engagement between the main drive shaft 25 and the individual winch drums 22-24. To this end, each of the core sleeves 61-63 of the winch drums is provided with at least one, and preferably a plurality (e.g., eight) of angularly spaced key slots 74 for the selective reception of portions of drive keys 75-77 (FIGS. 6-8). These drive keys are normally received in fully retracted positions in deep vertical slots 78-80 in the shaft 25. A mounting ring 81 (FIGS. 10A, 10B) is secured to a lower portion of the main drive shaft 25 and is formed with slots 82-84 to receive lower end portions of the drive keys. Each of the keys is provided with an opening 85 to receive a pivot pin (not shown), retained in a bore 86 in the mounting ring, for pivotally mounting the drive key to the mounting ring 81. The mounting ring itself is secured to the drive shaft by pins (not shown) received in radial openings 87 in the mounting ring and 88 in the shaft 25.

As indicated in FIGS. 6-8, each of the drive keys 75-77 is formed with a drum-engaging projection 90-92, each located at a different level along the length of its key. For example, the projection 90, extending from key 75, is positioned to align with the core sleeve 61 of the upper winch drum 22. The projection 91, of key 76, is positioned to align with the core sleeve 62 of the intermediate drum 23, and the projection 92, of key 77, is positioned to align with the core sleeve 63 of the lower winch drum 24. In the normal or retracted positions of the drum keys, the projections 90-92 are contained wholly within the circular outline of the drive shaft 25.

In order to cause the upper drum 22 to be engaged in driving relation with the shaft 25, the upper end of the key 75 is urged radially outward, to engage the key projection 90 in one of the slots 74 in the core sleeve 61 of the upper winch drum. The main body of the key 75 remains entirely within the confines of its shaft slot 74. Once the projection 90 is received within one of the slots 74, the upper drum is positively engaged with the shaft 25 for driven rotation. The other drums 23, 24 remain disconnected from the shaft and do not rotate therewith.

Figure 9:
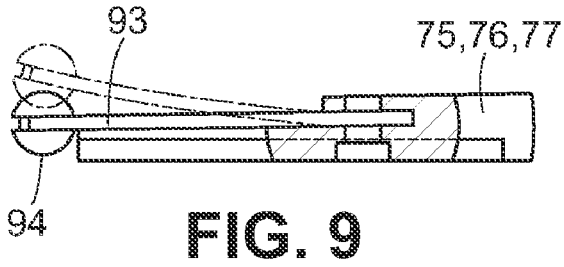
FIG. 9 is a fragmentary view illustrating an uppermost portion of a drive key mounting a novel form of actuating element.
Figure 13:
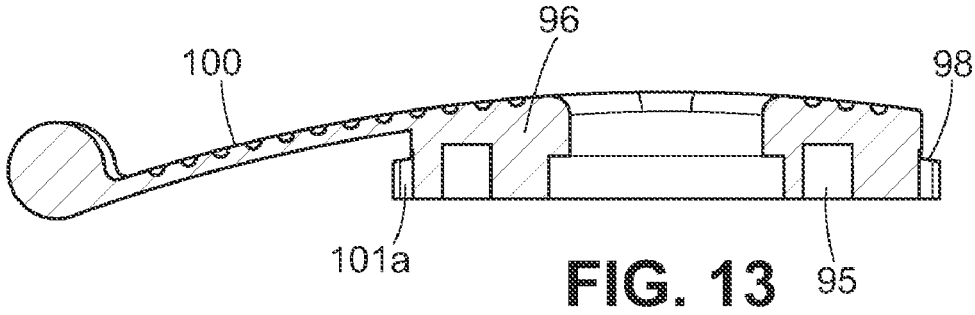
FIGS. 13, 14 are cross sectional and bottom plan views respectively of the control element of FIG. 12.
Figure 15:
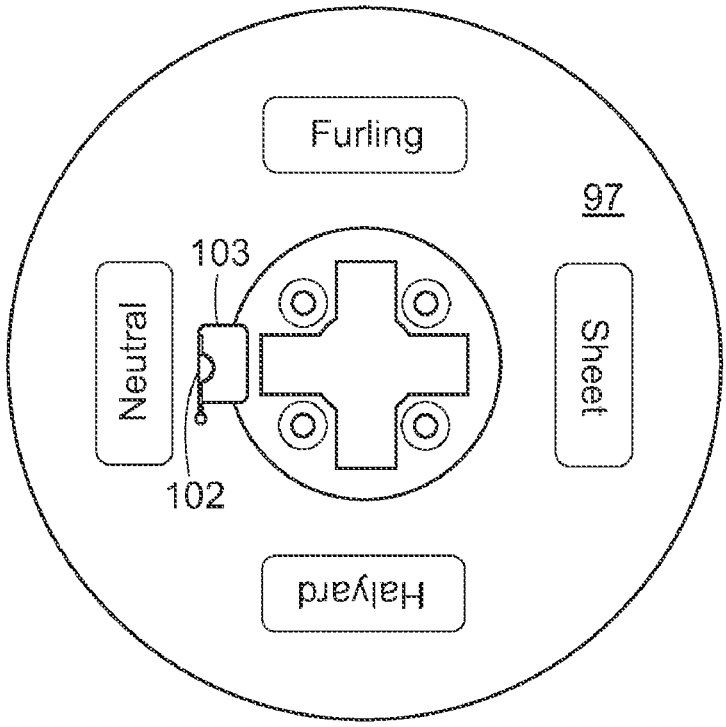
FIG. 15 is a top plan of a selector control cap which is mounted at the top of the main drive shaft.
Figure 16:
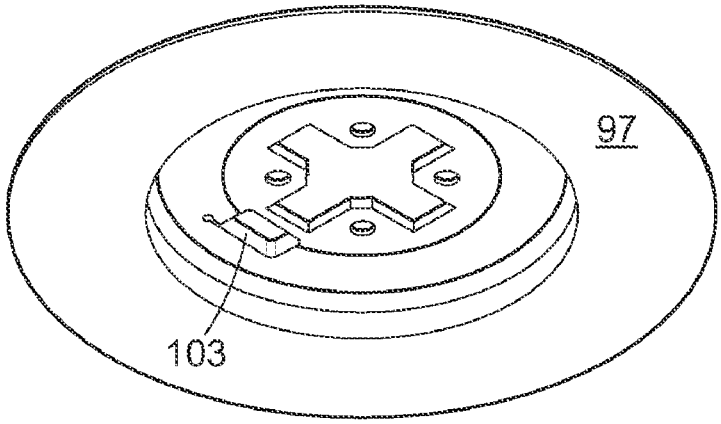
FIG. 16 is a perspective view, from underneath, of the control cap of FIG. 15.

For controllably actuating the drive keys 75-77, each of the keys is provided at its upper extremity with a flat metal spring element 93 (FIG. 9) carrying a vertically grooved spherical cam follower element 94 at its upper extremity. The cam followers 94, which are rotatable in the spring elements 93, are arranged to be received in a cam groove 95 formed in the bottom of a selector element 96 (FIG. 13). The selector element 96 is rotatably mounted on a selector cap 97 (FIGS. 15, 16), mounted on top of the ring 48 and bolted to the top of the shaft 25 through the ring 48. The selector element has a radially extending flange 98 around its lower periphery, which is confined by a cover element 99 fixed to the selector cap 95, to retain the selector element 96 in position on the selector cap, while permitting the selector element to be rotated relative to the selector cap. The selector element is provided with a lever arm 100 engageable by the operator to rotate the lever to one of its operating positions, of which there are four in the illustrated embodiment of the invention.

Figure 12:
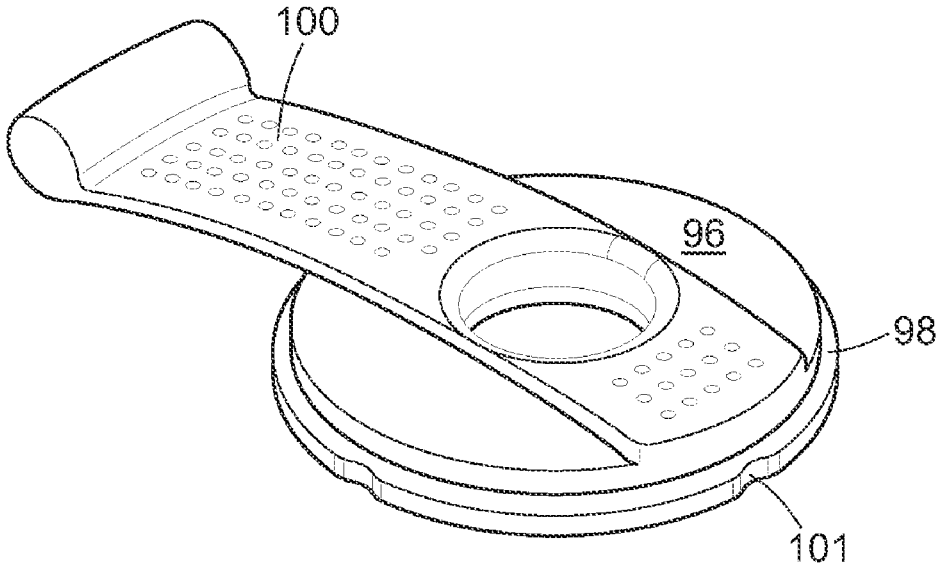
FIG. 12 is a top perspective view of a control member for manual selection of winch drum engagement.
Figure 14:
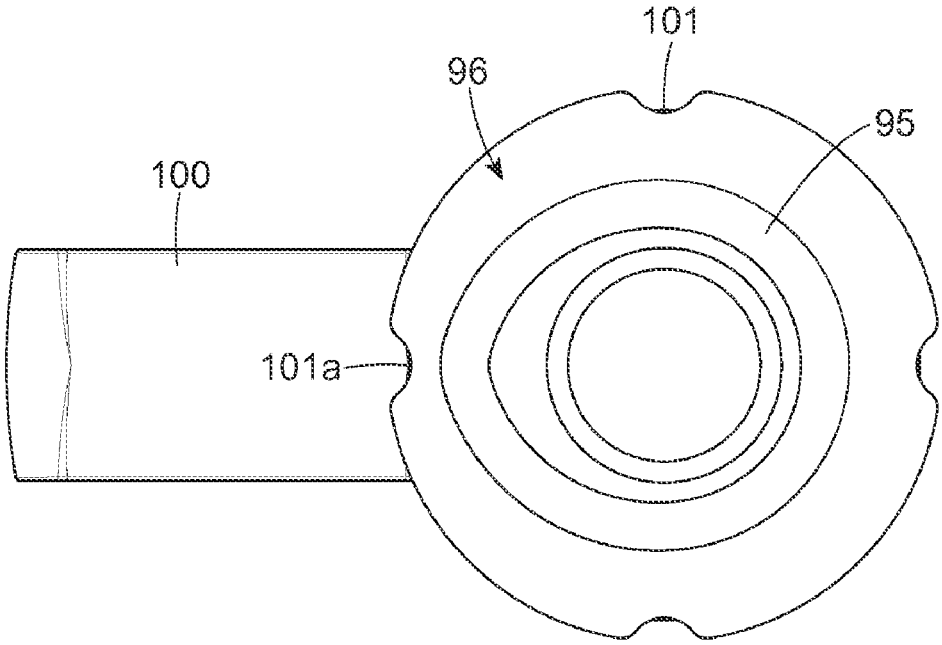

As shown particularly in FIGS. 12 and 14, the selector element 96 is provided with four detent notches 101 in the edge of the flange 98. These detent notches are arranged for cooperation with a detent spring 102 (FIG. 15) mounted in an opening 103 in the selector cap. Cooperation of the spring 102 and notches 101 serves to retain the selector element 96 in any of its four operative positions.

As shown in FIG. 14, the cam groove 95 is circular over approximately 180 degrees of its path, and is of progressively elongating radius toward the detent notch 101*a*, which is generally aligned with the operating lever 100. Thus, when the selector element 96 is rotated to a position in which the lever 100 is located directly over one of the drive keys 75-77, the cam follower 94 associated with that drive key is displaced radially outward, in order to urge that drive key radially outward into driving relation with its associated drum, with the projection 90-92 being received within the drive slot 74 of the associated core sleeve. Preferably, the several operative positions of the selector are marked of the selector cap 97, enabling the operator to immediately identify the desired drum to be engaged (or the "neutral" position if all drums are to be disengaged).

As will be appreciated, when the selector 96 is actuated to connect a particular drum to the shaft 25, the relevant drive key may not, at that time, be properly aligned with one of the drive slots 74. In such cases, the spring element 93 mounting the cam follower 94, simply flexes outward (see FIG. 9) pressing the projection 90-92 against the cylindrical inner surface of the core sleeve. As the shaft 25 rotates, it will, within a few degrees of rotation, cause the drive projection 90-92 to become aligned with the nearest slot 74, at which time the deflected spring 93 moves the associated key outward to effect driving engagement with the winch drum. During this initial driving phase, it is advantageous for the startup rotation of the shaft 25 to be carried out at slow speed for a few degrees, allowing the key and projection to be fully engaged before full power and speed is applied to the shaft 25. Suitable motor controls (not shown) can be provided for this purpose.

In order to disengage a drive key from its winch drum, the selector element 96 is rotated clockwise or counterclockwise, through 90 or 180 degrees. The cam follower 94 of the engaged key will accordingly be displaced radially inward to a position in which its associated drive key 90-92 is fully retracted from the related winch drum. In this respect, it will be observed in FIG. 9 that the configuration of the drive keys is such as to provide rigid support for the spring element 93 over most of its length, on the outside of the spring. Accordingly, when the selector is actuated to retract a key from an engaged drum, the spring element 93 is provided with a significant degree of rigidity, to enable the key to be forcibly withdrawn from the slot with which it is engaged. Thus, the spring action is asymmetrical, providing significant resilience during drum engaging actions, and significant rigidity during disengaging actions.

To advantage, controls for the drive motor can include a function, operative any time that the motor is brought to a stop, to effect a momentary reversal of direction, sufficient to unload the pressure on the operative drive key. This will facilitate retraction of the operative drive key when that is desired. As will be understood, it takes only the slightest amount of reverse movement to unload the drive key. It is contemplated that this operation will be performed at each and every stoppage of the motor, so that the drive keys are always unloaded when the winch is at rest. If the winch is set up for manual operations, unloading of the operative drive key is effected by a slight winding-in motion of the winch handle, followed by a release. Normal "play" in the anti-reverse pawls of the winch automatically allow a slight reversal of the winch drum, which will relieve tension on the active line and thus unload the drive key.

In the illustrated form of the invention, the selector element has four working positions corresponding to the three detent notches 101 and the fourth notch 101*a*. When the selector lever 100 is rotated to a position overlying any of the three drive keys 75-77, that key will be urged into driving engagement with the associated winch drum. The other two drive keys will be held in fully retracted positions. When the selector lever 100 is rotated to its "neutral" position in which it overlies none of the drive keys, all three of the drive keys will be held in retracted positions, so that none of the winch drums is engaged with the drive shaft 25 and all are able to free wheel.

It is contemplated that selective operations of the drive keys (or other mechanisms for selective engagement of the winch drums) can be automated and subject to remote control, so that winch operations can be controlled from the helm station, for example.

Figure 18:
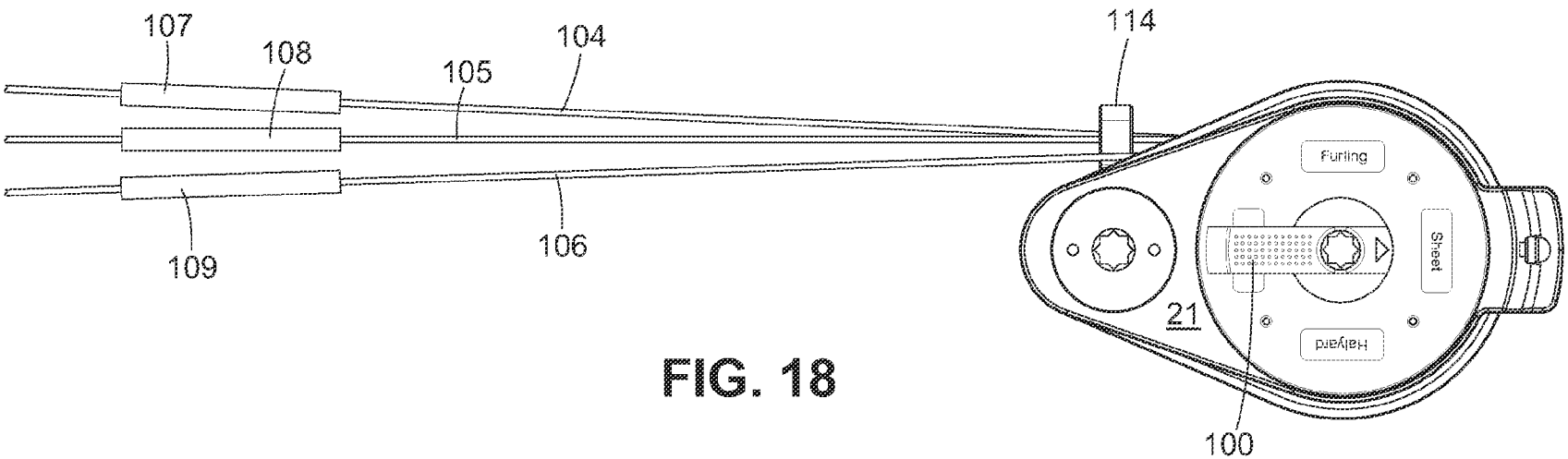
FIG. 18 is a representation of a typical installation of the new winch, operating in conjunction with separate line clutch mechanisms, for operating three sets of running lines.

As shown in FIG. 18, each of three running lines coming from the winch 21 can be passed through line clutches 107-109 before being led to the mast, boom or other location where the line function is to be performed. The line clutches 107-109, which are commonly used on sailing yachts and are well known in the art, typically are constructed to allow line to be easily drawn through the clutch in a direction toward the winch, while locking the line against movement away from the winch. The clutches typically are provided with manual levers which, when opened, permit free line movement in both directions. Accordingly, in typical operation of the winch of the invention, the line clutch for a given line will be closed when the winch drum containing that line is disconnected from the drive shaft and it is intended that line should not be paid out from the disconnected winch drum. In some instances, however, when line is being retrieved on one of the winch drums, it is simultaneously paid out on another of the winch drums, as when hoisting the main sail halyard and simultaneously releasing the main sail furling line (or vice versa). In such cases, the clutch for the line to be released is opened, and the line is released against resistance provided by the line release control elements 73.

Normally, the line clutches 107-109 are devices that are separate from the winch. However, it is contemplated that the functions of the line clutches may be incorporated into the winch itself, by mechanisms acting on the individual winch drums to prevent or permit rotation of a drum that is disconnected from the main drive shaft 25. Likewise, it is contemplated that the functions of the line clutches, whether separate elements or incorporated into the winch, can be operationally automated such that the proper clutches will be opened or closed in response to controlled operations of individual winch drums.

Copending application Ser. No. 11/759,398 discloses a novel form of line guide mechanism which is driven to operate with rotations of the winch drum and serves to apply the line to the winch drum in even layers. A modified form of such a line guide mechanism is incorporated into the present winch, as shown particularly in FIGS. 1, 3 and 17.

With reference to FIG. 3, the line guide mechanism 58 includes a level wind sleeve 110 formed with a bidirectional groove 111. The sleeve 110 is engaged through an intermediate idler gear 112 with a drive gear 113 secured to the main drive shaft 25. Accordingly, whenever the shaft 25 is rotated, whether manually or under power, the level wind sleeve 110 is correspondingly rotated.

In the illustrated form of the invention, the level wind mechanism is desired for operation with only the two lower drums 23, 24, which are intended for operation with longer lines and thus have greater width than the upper drum 22 which may operate with a shorter line, such as the main sheet. The narrower drum thus does not normally require a level wind facility, although one could be provided if necessary.

With respect to the two lower drums, for which level wind is provided in the illustrated form of the invention, a dual line guide element 114 (FIG. 1) is engaged with the level wind sleeve 110 and is driven thereby to travel vertically in a reciprocating path according to the extent of the bidirectional groove 111. In the illustrated winch, the vertical extent of that groove corresponds to the vertical height of the individual lower drums 23, 24.

Figure 17:
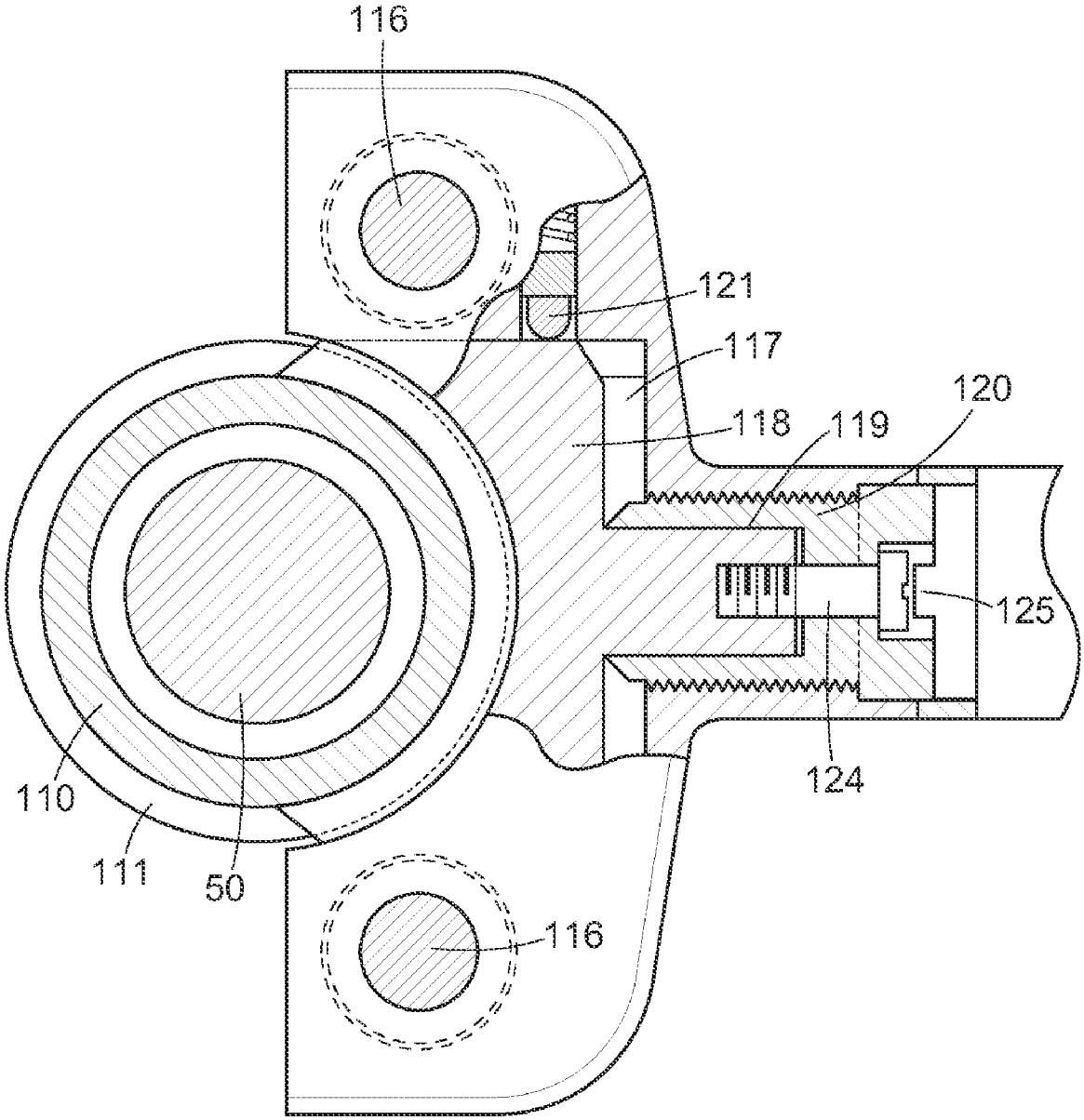
FIG. 17 is a top view, partly in section, illustrating features of a line guide mechanism incorporated in the winch of FIG. 1.

With reference to FIG. 17, the level wind mechanism includes a yoke 115, which is mounted for sliding movement on guide rods 116 for vertical travel adjacent to the level wind sleeve 110. The yoke 115 partially surrounds the level wind sleeve 110 and is formed with a recess 117 receiving a blade-like groove follower 118. The groove follower 118 has a cylindrical extension 119 which is received in a sleeve 120 for limited tilting movement within the recess 117. The groove follower 118 is enabled to tilt through a few degrees from horizontal as it follows the bidirectional groove 111 to its end extremities and then tilts in an opposite direction to continue following the groove toward the opposite extremity. Desirably, a detent 121 is provided to retain the follower 118 in either of its tilted positions after it goes through a transition at the ends of the bidirectional groove.

In case of malfunction with the level wind guide mechanism, provision is made for retracting the groove follower 118 from the bidirectional groove 111. To this end, the sleeve 120 is threadedly engaged in the yoke 115 and is attached to the follower extension 119 by means of a screw 124, which permits rotation of the extension 119 relative to the sleeve 120. The sleeve 120 normally is seated in a forward limit position in the yoke. However, should a malfunction occur, the sleeve 120 may be engaged via a tool slot 125 and rotated to back the sleeve 120 out sufficiently to clear the follower 118 from the groove 111. This allows the winch to be operated without the reciprocating action of the line guide.

The line guide element 114, as shown in FIG. 1, comprises upper and lower line guides 122, 123 which are aligned generally with the lower drums 23, 24 and are arranged to have operating excursions generally between the upper and lower flanges 64, 65 of those winch drums. Accordingly, when either of the drums 23, 24 is operated, the level wind mechanism automatically operates to reciprocate the line guide element 114. This serves to apply line uniformly in back and forth layers on the working drum. With respect to the adjacent drum, which is not being driven, the line guide reciprocates, but does not affect the line on the drum.

As in the case of the winch of copending application Ser. No. 11/759,398, the socket member 50 of the level wind mechanism can receive a standard winch handle for manual operation of the winch, if necessary or desirable. As explained in the copending application, rotation of the socket member 50 in one direction operates through gear mechanisms in the gear box 32 to drive the main gear 53 at a first gear-reduced speed. Rotation of the winch handle in an opposite direction will drive the main gear 53 at a different gear-reduced speed. In either case, rotations of the socket member 50 will drive the main gear 53 unidirectionally at one of the two selected low speeds. Operation of the winch through the main socket member 49 will operate the shaft 25 on a one-to-one ratio (i.e., at relatively high speed compared to operations of the winch through the socket member 50).

The multi-function winch of the invention has numerous and significant advantages as compared to standard yacht winches, whether manual or power operated. Importantly, no manual handling of lines is required, which eliminates a very significant hazard from the operation of a sailing yacht. With yachts of thirty-five feet and above, for example, the forces on many lines of the running rigging can be exceedingly high, and crewmembers can be seriously injured if they become entangled in a line under load and/or in a line passing over a winch. Inexperienced crewmembers are particularly subject to such injuries. With the new winch, manual handling of lines is completely eliminated. Moreover, with the new winch, the lines drawn in by the winch are at all times self-contained on the winch and are not, as with conventional winches, simply collected on the deck or in the cockpit, where they can easily become confused with other lines or entangled with crewmembers. With conventional winches, lines being released under load can escape from the winch, leading to burning of the hands and possible other, more serious injuries. Also, with conventional winches, an "override" can sometimes occur, in which line under load overrides a coil of line that should be above it on the winch. The overridden coil then becomes trapped under load, and releasing it can be both difficult and dangerous. The winch of the invention eliminates problems of this nature.

A typical large sailing yacht is literally studded with winches located on the deck, and in the cockpit, because of the need to handle multiple lines of running rigging. With the winch of the present invention, the number of required winches may be reduced significantly because a single winch is able to handle multiple lines on multiple winch drums, all mounted on a single drive shaft and selectively engageable for individual operation. Even in cases where the new winch is designed exclusively for manual operations, crew work is greatly simplified because multiple line operations may be carried out from a single location. In this respect, while conventional winches, utilized in conjunction with line clutches, can be arranged to service multiple lines of running rigging, changing from one line to another involves a number of steps in removing a first line from the winch and installing another. With the winch of the invention, all of the lines serviced by the winch are permanently attached to and stored by the individual winch drums, and it is merely a matter of selecting a particular winch drum to be driven by the winch.

Where a conventional winch is set up to service a plurality of lines, the lines are typically color-coded to facilitate identification. Even so, when a crewmember approaches the winch to operate a main halyard, for example, the crewmember must first select among the various available lines the particular one that is the main halyard. This takes time and is an opportunity for error. With the winch of the present invention, when the crewmember approaches the winch to operate the selector element 96, the line selection is labeled on the top of the winch itself, and the crewmember simply moves the selector element to the desired position, as identified on the winch. There is no need to look away from the winch to identify the desired line. With the winch of the invention, line selection is thus quick and error free.

In the power driven versions of the new winch, extensive possibilities for remote operation are available, limited mostly by budgetary considerations. For example, it is contemplated that a helmsman, operating at the helm station of a yacht, may remotely activate a particular drum of the multifunction winch for remote control release and/or retrieval of line. It is also contemplated that cooperative functions may be subject to automatic remote control, such as the simultaneous retrieval of a main halyard and release of the associated furling line.

It should be understood that the specific form of the invention herein illustrated and described is representative only of the basic principles of the invention, and reference should be made to the following appended claims in determining the full scope of the invention.

The invention claimed is:

1. A winch for a sailing yacht having multiple lines of running rigging, which comprises (a) a support structure adapted to be fixed to the yacht, (b) a primary shaft mounted in said support structure for controllable rotation, (c) means for controllably rotating said primary shaft, (d) a plurality of winding drums mounted on said primary shaft in axially adjacent relation for winding and storing said lines, said winding drums being adapted for rotation independently of other winding drums and independently of said primary shaft, (e) a drum-engaging drive element for each of said winding drums recessed in said shaft and surrounded and confined by portions of said winding drums, (f) said drum-engaging drive elements being controllably movable radially into engagement with said winding drums to provide driving engagement between said shaft and said winding drums, and (g) selector means for selectively radially displacing individual ones of drum-engaging drive elements for engaging selected winding drums for rotation with said primary shaft.

2. A winch according to claim 1, wherein (a) said drum-engaging drive elements are disposed in axial relation to said shaft, (b) said primary shaft has axially disposed recesses for receiving said drum-engaging drive elements in radially retracted relation to said winding drums, and (c) said selector means comprises a control element for selectively radially displacing a selected one of said drum-engaging drive elements for simultaneous engagement with said primary shaft and a selected one of said winding drums.

3. A winch according to claim 2, wherein (a) said drum-engaging drive elements are elongated drive keys extending axially along said primary shaft, (b) said primary shaft is formed with outwardly facing axial recesses for said drive keys, and (c) said winding drums each include a generally cylindrical core sleeve surrounding said primary shaft and provided with at least one axially extending recess for engagement with a drive key for establishing driving engagement between a selected winding drum and said primary shaft.

4. A winch according to claim 3, wherein (a) each of said drive keys is formed with an outwardly extending drum-engaging projection aligned with a particular one of said winding drums, (b) said outwardly facing axial recesses of said primary shaft being of a depth to retain said drive keys with said respective drum engaging projections out of contact with their respective drums.

5. A winch for a sailing yacht having multiple lines of running rigging, which comprises (a) a support structure adapted to be fixed to the yacht, (b) a primary shaft mounted in said support structure for controllable rotation, (c) means for controllably rotating said primary shaft, (d) a plurality of winding drums mounted on said primary shaft in axially adjacent relation for winding and storing said lines, said winding drums being adapted for rotation independently of other winding drums and independently of said primary shaft, (e) selector means for selectively engaging individual winding drums for rotation with said primary shaft, (f) said selector means comprising a plurality of drive elements, one for each winding drum, (g) said primary shaft having recesses for receiving said drive elements in retracted relation to said winch drums, and (h) actuating means for selectively displacing a selected drive element for simultaneous engagement with said primary shaft and a selected winding drum, (i) said selector means comprising resilient means for urging a selected drive element radially outward, and (j) said winding drums being provided with at least one recess for engagement with an outwardly urged drive element when said at least one recess becomes rotationally aligned with such drive element.

6. A winch according to claim 5, wherein (a) said drive elements are elongated drive keys extending axially with respect to said primary shaft and received in axially extending key slots formed therein, (b) said drive keys are secured at lower ends thereof for limited outward movement of upper portions thereof, (c) said resilient means comprises spring elements secured adjacent upper ends of said drive keys and extending upward therefrom, (d) said selector means comprises a selector element rotatably mounted at a top of said winch and provided with a cam groove on an underside thereof for engaging portions of said spring elements, (e) said cam groove is formed such that, in most positions of engagement with said spring elements, said elements are urged in an inward direction to retain the drive keys associated therewith in retracted positions, and (f) said cam groove has at least one position which, when engaged with a spring element, resiliently urges the drive key associated therewith in an outward direction to effect driving engagement of said drive key with a selected winding drum.

7. A winch according to claim 6, wherein (a) said spring elements are spring strips anchored in said drive keys at positions below upper end extremities thereof, (b) portions of said drive keys on radially inward sides of said spring strips extend upward along said spring strips to minimize flexing thereof in a radially inward direction, and (c) said spring strips are substantially free to flex in a radially outward direction, (d) whereby, radially inward movement of upper ends of said spring strips effects substantially positive inward movement of said drive keys, while radially outward movement of an upper end of a spring strip resiliently urges the drive key associated therewith radially outward to effect driving engagement with a winding drum when a recess in said drum becomes aligned with such drive key.

8. A winch according to claim 6, wherein (a) said cam groove is formed in a continuous configuration, and (b) said cam groove has at least one position in which all of said drive keys are confined in retracted positions.

9. A winch according to claim 5, wherein (a) said drive elements are elongated drive keys extending axially with respect to said primary shaft and received in axially extending key slots formed therein, (b) said drive keys are secured at lower ends thereof for limited movement of upper portions thereof, (c) said selector means comprises a selector element rotatably mounted at a top of said winch and provided with cam means for displacing upper end portions of said drive keys radially inward and outward, (d) said resilient means being associated with said selector means and being operative to resiliently urge a selected drive key in a radially outward direction, and (e) said selector means being operative to impart a substantially positive movement to a selected drive key in a radially inward direction to effect retraction of an outwardly displaced drive key.

10. A winch for a sailing yacht having multiple lines of running rigging, which comprises (a) a support structure adapted to be fixed to the yacht, (b) a primary shaft mounted in said support structure for controllable rotation, (c) means for controllably rotating said primary shaft, (d) a plurality of winding drums mounted on said primary shaft in axially adjacent relation for winding and storing said lines, said winding drums being adapted for rotation independently of other winding drums and independently of said primary shaft, (e) selector means for selectively engaging individual winding drums for rotation with said primary shaft, (f) a level wind element positioned in parallel relation to said primary shaft and driven for rotation in synchronism therewith, (g) said level wind element having a bidirectional groove thereon, (h) a level wind carrier associated with said level wind element and adapted for reciprocating movement thereon as said level wind element rotates unidirectionally, and (i) a plurality of level wind guide elements fixed to said carrier for movement therewith, (j) said plurality of level wind guide elements being aligned generally with particular ones of said winding drums for effecting uniform winding of line on said drums when said drums are drivingly rotated by said primary shaft.

* * * * *